United States Patent [19]

Tippmann

[11] Patent Number: 4,932,672

[45] Date of Patent: Jun. 12, 1990

[54] NONLETHAL HAND GRENADE

[76] Inventor: Dennis J. Tippmann, 12708 Parent Rd., Fort Wayne, Ind. 46809

[21] Appl. No.: 296,990

[22] Filed: Jan. 17, 1989

[51] Int. Cl.[5] ..... A63B 65/00

[52] U.S. Cl. ..... 273/428; 273/418

[58] Field of Search ..... 273/428, 418; 102/368, 102/395, 498, 502, 513, 529

[56] References Cited

U.S. PATENT DOCUMENTS

| | | | |
|---|---|---|---|
| 1,815,300 | 7/1931 | Harris | 273/418 X |
| 3,528,662 | 9/1970 | Merchant et al. | 273/418 |
| 3,782,286 | 1/1974 | Jones et al. | 102/513 X |
| 3,785,569 | 1/1974 | Helmrich | 102/368 X |
| 3,791,303 | 2/1974 | Sweeney et al. | 102/513 X |
| 4,627,354 | 12/1986 | Diamond et al. | 102/368 |
| 4,656,092 | 4/1987 | Haman et al. | 102/529 X |

*Primary Examiner*—Paul E. Shapiro

*Attorney, Agent, or Firm*—Roger M. Rickert

[57] ABSTRACT

An impact actuated nonlethal hand grenade is disclosed having a flexible, preferably natural rubber resilient casing containing a pressurized marking fluid. The casing has an opening and a ball received within the opening, whereby, when the hand grenade is thrown, the subsequent impact of the grenade with an object and the resulting hydrostatic shock through the fluid within the grenade will dislodge the ball from the opening allowing the discharge of fluid from the opening and onto surrounding objects. A crimp located about midway along a selected length of tubing forms first and second segments of that tube each pinched off and sealed at one end and open at the other end and the marking fluid is forced under pressure into the open ends of the sealed segments of tube stretching the sidewall of the segments. Balls or similar plugs are inserted into the open ends of the segments while maintaining the fluid pressure within the segments thereby forming a joined pair of sealed pressurized containers of marking fluid. Banding together of the sealed pressurized containers and folding the free segment tube ends over to pinch the tubes shut near the balls aids retention of the balls in their respective tubes. Capping the folded tube ends and a retaining pin holding the cap helps to maintain the folds and aid retention of the plugs until the grenade is ready for use.

14 Claims, 2 Drawing Sheets

NONLETHAL HAND GRENADE

SUMMARY OF THE INVENTION

The present invention relates generally to marking devices and more particularly to a hand thrown impact actuated marking device. In particular, the present invention relates to a nonlethal hand grenade with may be used for recreational or training purposes.

A variety of guns for firing relatively fragile projectiles which contain a colored liquid and break on impact marking the target are known. These marking runs are sometimes called paint ball guns. Marking guns typically use compressed gas pressure to fire a gelatinous capsule containing a marking material. The capsule breaks on impact with a target dispersing the material to mark the target where hit by the capsule. A recent popular recreational use for marking guns is in the "Survival Game", a kind of mock war where opposing sides attempt to seek out and "kill" one another by marking the opposition with a paint ball. It would be desirable to incorporate other nonlethel weaponry which simulate analogous real weapon into such gases as well as being desirable to provide such practice weaponry ;or military training purposes.

Among the several objects of the present invention may be noted the provision of a nonlethal projectile which splatters a marking fluid on nearby objects upon impact: the provision of a projectile in accordance with the previous object high dispenses the marking fluid in an erratic pattern so as to mark almost all objects within about twenty feet of the point of impact; the provision of a harmless hand grenade for practice or recreation: the provision of a unique technique for fabricating an impact actuated marking projectile; and the provision of a hand thrown nonlethal weapon. These as well as other objects and advantageous features of the present invention will be in part apparent and in part pointed out hereinafter.

In general, an impact actuated nonlethal hand grenade has a flexible resilient casing formed of surgical or similar natural rubber hose containing a pressurized marking fluid. The casing has an opening at one end and an opening blocking member in the form of a ball received within the opening. When the hand grenade is thrown, the subsequent impact of the grenade with an object and the resulting hydrostatic shock through the fluid within the grenade will dislodge the ball from the opening allowing the discharge of fluid from the opening and onto surrounding objects. Preferably, there are two separate, but mechanically coupled pressurized compartments in the grenade so that, upon impact and the dislodging of both balls from their respective openings, the unbalanced forces from each compartment only partially cancel one another and cause the grenade to move about in an erratic pattern and dispense marking fluid in many directions.

Also in general and in one form of the invention, an impact actuated marking projectile is fabricated by selecting a length of resilient tubular material and crimping the selected length at a location therealong to create at least one and preferably two segments of tube pinched off and sealed at one end and open at the other end. A marking fluid under pressure is forced into the open end of the sealed segment of tube stretching the sidewall of the segment and a plug is inserted into the open end of the segment while maintaining the fluid pressure within the segment to thereby form sealed pressurized container of marking fluid. Folding the tube end over to pinch the tube shut near the plug and capping the folded tube end to maintain the fold will aid retention of the plug in the tube until the marking projectile is ready for use.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
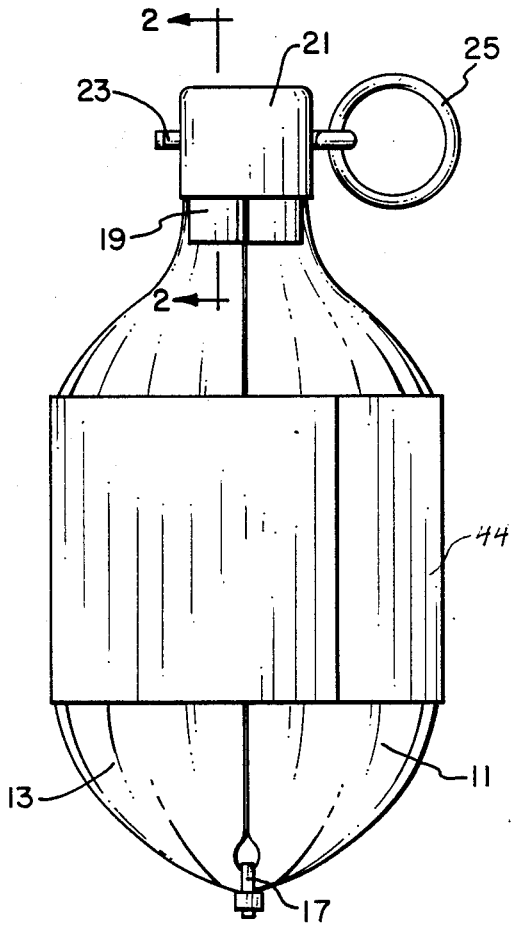
FIG. 1 is a side elevation view of a hand grenade illustrating the invention in one form.
Figure 3:
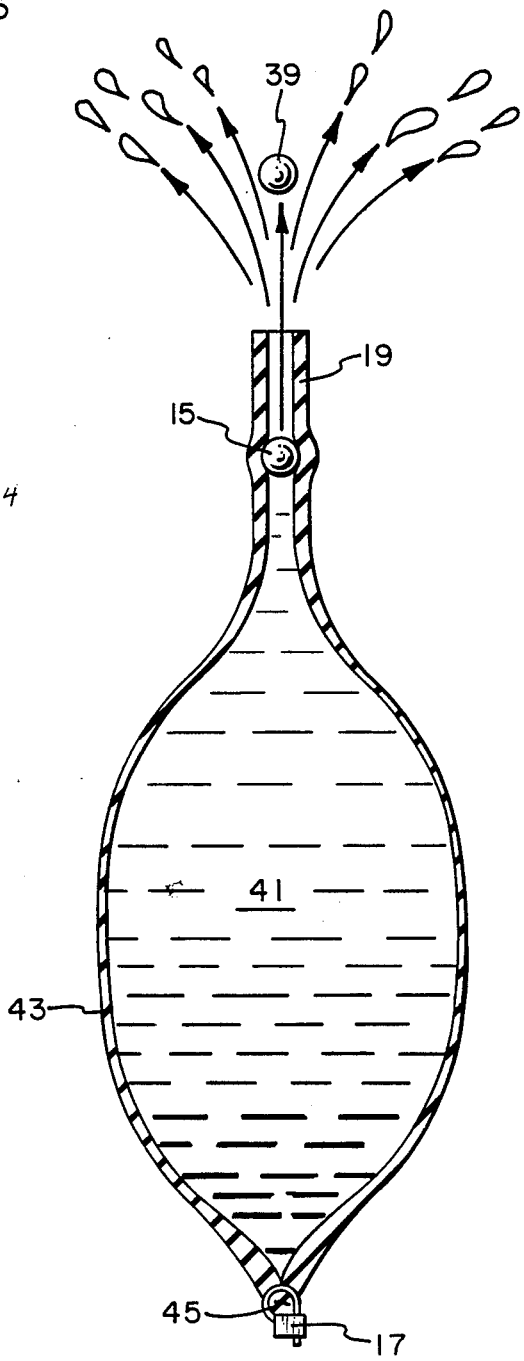
FIG. 3 is a cross-sectional view of one lobe of the hand grenade of FIG. 1 illustrating the effect of an impact on the device.
Figure 2:
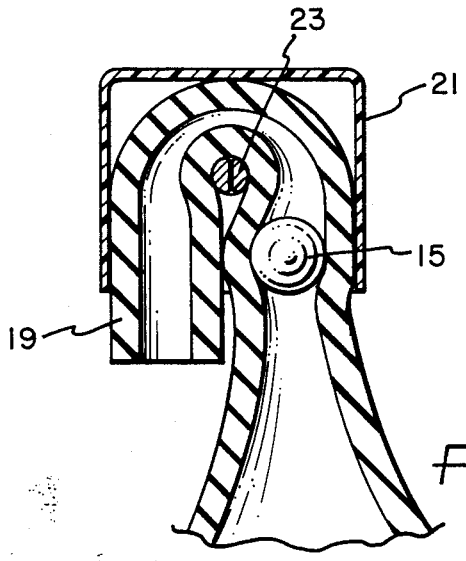
FIG. 2 is a view in cross-section of a portion of the hand grenade along line 2—2 of FIG. 1.

The impact actuated nonlethal hand grenade is illustrated in FIGS. 1–8 and is formed from a flexible resilient tubular material. The grenade includes a pair of enlarged or distended sections 11 and 13 of tubular material each sealed at one end by a blocking member such as the ball 15 and at the other common end by an external crimping member 17. The two distended sections or lobes each contain marking fluid such as a coloring material in an aqueous medium pressurized to about fifty pounds per square inch by the stressed sidewalls of the tube The tubular material may comprise a section of natural rubber hose such as conventional surgical hose of about eight inches in length, about three-sixteenths of an inch inside diameter, and about three-eights of an inch outside diameter. The blocking member comprises a ball about one-quarter of an inch in diameter for hose of this size so that the ball is securely retained within the tube. Thus, the casing for the grenade comprises a section of tubular material sealed near the middle thereof by the external crimping member 17 which is tightly secured about and squeezes the tubular material shut thereby creating two tubular segments each to be filled with liquid under pressure to form the lobes 11 and 13. The blocking member 15 is inserted into the tubular material a distance sufficient to allow the tubular member portion 19 extending beyond the blocking member to be folded as shown in FIG. 2 to further secure the blocking member 15 within the casing. A cap 21 may be positioned over the folded portion to maintain the fold and a pin 28 passed crosswise through the cap 21 and through the fold to hold the cap in position. The pin 23 is removed by pulling on the ring 25 and the cap 21 falls free preparatory use of the hand grenade. When the hand grenade is thrown, the subsequent impact of the grenade with an object and the resulting hydrostatic shock which is transmitted through the fluid within the grenade and in particular, to the ball 15, increases the pressure on the ball and dislodges the the ball 15 from the open end of tube portion 19, as depicted in FIG. 3, allowing the discharge of fluid from the opening and onto surrounding objects.

FIG. 3 illustrates the ball moving outwardly at 39 allowing the pressurized marking fluid 41 to squirt from open end 19. When the ball 15 is expelled, the resilience of sidewall portions such as 43 maintain the pressure so as to dispel virtually all of the fluid 41 over a time interval on the order of one second. Release of the pressure at the top of the grenade as viewed creates an unbalanced force downward which would cause the grenade to shoot off in one direction were it not for the fact that a second lobe (not shown in FIG. 3) connected at 45 is experiencing a similar unbalanced force at an obtuse angle thereto. The two forces interact to cause the erratic spraying motion. Thus, the grenade is provided with two lobes fastened together and has two distended portions filled with pressurized fluid so that when impact dislodges the blocking members, the resulting unbalanced forces partially cancel one another and the grenade exhibits an erratic motion spraying marking fluid generally throughout the immediate vicinity of the grenade. A grenade having a single distended or enlarged portion and only one blocking member would be propelled generally in one direction much like a balloon which is inflated and then released.

Figure 4:
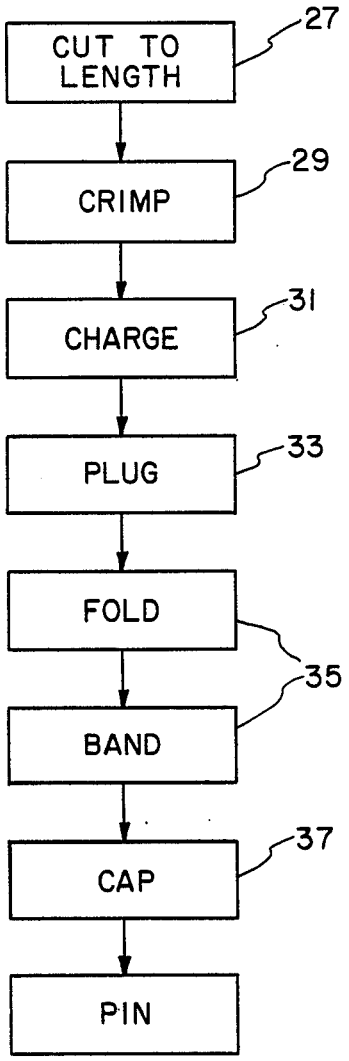
FIG. 4 is a schematic illustration of the process of charging an impact actuated marking projectile such as the hand grenade of FIGS. 1–3.

The technique for making such an impact actuated marking projectile is illustrated schematically in FIG. 4 and begins with the selection of a length of resilient tubular material as shown at 27. Crimping member 17 is then applied as shown at 29 thereby crimping the selected length at a location therealong to create at least one segment of tube pinched off and sealed at one end and open at the other end. Preferably the crimping takes place near the middle of the selected length to create two similar segments. Step 31 illustrates forcing the marking fluid under pressure into the open ends of the sealed segments of the tube stretching the sidewalls of the segments to form aneurysms or distended portions filled with fluid. The aneurysms are sealed off at 38 by inserting a plug such as the ball 15 into the open ends of the segments while maintaining the fluid pressure within the segments thereby forming a joined pair of sealed pressurized containers of marking fluid.

Step 85 illustrates the additional step of folding the free ends of the tube over as depicted in FIG. 2 to pinch the tube shut near the plug 15 and aid retention of the plug in the tube. Capping the folded tube end to maintain the fold until the marking projectile is ready for use is shown at 37. In the preferred case where the crimp is located about midway along the selected length so that a second segment of tube pinched off and sealed at one end and open at the other end is also created, step 35 may include the banding together of the sealed pressurized container and second sealed pressurized container to create an easily carried and easily thrown grenade. The band 44 may be a cloth, paper or net-like wrap.

From the foregoing, it is now apparent that a novel arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An impact actuated nonlethal hand grenade comprising a flexible resilient casing containing a pressurized marking fluid, the casing having an opening and an opening blocking member received within the opening, whereby, when the hand grenade is thrown, the subsequent impact of the grenade with an object and the resulting hydrostatic shock through the fluid within the grenade will dislodge the member from the opening allowing the discharge of fluid from the opening and onto surrounding objects, the casing comprising a distended section of tubular material sealed at one end by the blocking member and at the other end by an external crimp.

2. The hand grenade of claim 1 wherein the marking fluid comprises a coloring material in an aqueous medium pressurized to about fifty pounds per square inch.

3. The hand grenade of claim 1 wherein the tubular material comprises a section of natural rubber hose of about eight inches in length, about three-sixteenths of an inch inside diameter, and about three-eights of an inch outside diameter, and the blocking member comprises a ball about one-quarter of an inch in diameter.

4. The hand grenade of claim 3 wherein the blocking member is inserted into the tubular material a distance sufficient to allow the tubular member portion extending beyond the blocking member to be folded to further secure the blocking member within the casing, and further comprising a cap positioned over the folded portion to maintain the fold and a pin extending crosswise through the cap and through the fold to hold the cap in position, the pin being removed preparatory use of the hand grenade.

5. An impact actuated nonlethal hand grenade comprising a flexible resilient casing containing a pressurized marking fluid, the casing wiring an opening and an opening blocking member received within the opening, and an external crimping member, the casing comprising a section of tubular material sealed near the middle thereof by the external crimping member being tightly secured about and squeezing the tubular material shut thereby creating two tubular segments, one segment having said opening and said opening blocking member and the other segment having a second opening, and a second opening blocking member received within the second opening whereby, when the hand grenade is thrown, the subsequent impact of the grenade with an object and the resulting hydrostatic shock through the fluid within the grenade will dislodge the member from the opening allowing the discharge of fluid from the opening and onto surrounding objects.

6. The hand grenade of claim 5 wherein the casing comprises a pair of distended sections of tubular material each filled with pressurized marking fluid, sealed near respective first ends by the blocking members and at a common end by the external crimping member.

7. The hand grenade of claim 7 wherein the blocking members are each inserted into the tubular material a distance sufficient to allow the tubular member portions extending beyond the blocking members to be folded to further secure the blocking members within the casing, and further comprising a cap positioned over the folded portions and a pin extending crosswise through the cap and through the folds to hold the cap in position, the pin being removed preparatory use of the hand grenade.

8. The method of making an impact actuated marking projectile comprising:

selecting a length of resilient tubular material;

crimping the selected length at a location therealong to create at least one segment of tube pinched off and sealed at one end and open at the other end;

forcing a marking fluid under pressure into the open end of the sealed segment of tube stretching the sidewall of the segment;

inserting a plug into the open end of the segment while maintaining the fluid pressure within the segment thereby forming a sealed pressurized container of marking fluid.

9. The method of claim 8 including the additional step of folding the tube end over to pinch the tube shut near the plug and aid retention of the plug in the tube.

10. The method of claim 9 including the further step of capping the folded tube end to maintain the fold until the marking projectile is ready for use.

11. The method of claim 8 wherein the crimp is located about midway along the selected length so that a second segment of tube pinched off and sealed at one end and open at the other end is also created, the method including the additional steps of:

forcing a marking fluid under pressure into the open end of the second sealed segment of tube stretching the sidewall of the second segment;

inserting a plug into the open end of the second segment while maintaining the fluid pressure within the second segment thereby forming a second sealed pressurized container of marking fluid.

12. The method of claim 11 including the further step of banding together the sealed pressurized container and second sealed pressurized container.

13. The method of claim 11 including the additional step of folding the second segment tube end over to pinch the tube shut near the plug and aid retention of the plug in the tube.

14. The method of claim 13 including the further step of capping the folded tube ends to maintain the folds and aid retention of the plugs until the marking projectile is ready for use.

* * * * *